United States Patent [19]

Kasuga et al.

[11] 4,405,224

[45] Sep. 20, 1983

[54] ELECTROPHOTOGRAPHIC APPARATUS HAVING MEANS FOR REMOVING UNDESIRED CHARGE CONCENTRATED ON AN EDGE PORTION OF A PHOTOSENSITIVE MEMBER

[75] Inventors: Muneo Kasuga; Masaji Nishikawa; Tomoki Funakubo, all of Hachioji, Japan

[73] Assignee: Olympus Optical Company Limited, Tokyo, Japan

[21] Appl. No.: 210,386

[22] Filed: Nov. 17, 1980

[30] Foreign Application Priority Data

Nov. 22, 1979 [JP] Japan ..... 54-150684

[51] Int. Cl.[3] ..... G03G 21/00

[52] U.S. Cl. ..... 355/3 R; 355/3 TR

[58] Field of Search ..... 355/3 TR, 3 R, 7, 11, 355/16

[56] References Cited

U.S. PATENT DOCUMENTS 3,912,387 10/1975 Brooke ..... 355/3 R 4,171,157 10/1979 Suzuki ..... 355/3 TR 4,173,406 11/1979 Oyama et al. ..... 355/3 R

*Primary Examiner*—R. L. Moses

*Attorney, Agent, or Firm*—Fleit, Jacobson & Cohn

[57] ABSTRACT

An electrophotographic apparatus for producing one or more copied images of an original by forming an electrostatic latent image of the original on a photosensitive member whose width is narrower than that of a recording paper, developing the latent image, and transferring the developed image onto the recording paper, the apparatus including a device for removing electric charge from edge portions of the photosensitive member after said transferring but before next succeeding development of said latent image in the course of repeating developments and transferrings of one electrostatic latent image formed on said photosensitive member.

4 Claims, 4 Drawing Figures

ELECTROPHOTOGRAPHIC APPARATUS HAVING MEANS FOR REMOVING UNDESIRED CHARGE CONCENTRATED ON AN EDGE PORTION OF A PHOTOSENSITIVE MEMBER

BACKGROUND OF THE INVENTION

1. Field of the Invention

This invention relates to an electrophotographic apparatus for producing one or more copied images of an original on one or more sheets of recording paper, by repeating development and transferring of an electrostatic latent image of the original once formed on a photosensitive member.

2. Description of the Prior Art

Various electrophotographic apparatus for producing copies of an original are known, and an example of such apparatus generally uses a photosensitive member whose width is narrower than that of a recording paper, and an electrostatic latent image once formed on the photosensitive member is repeatedly developed and transferred onto one or more sheets of the recording paper. The electrophotographic apparatus using the aforesaid photosensitive member has shortcoming in that, as the member of the transferrings increases, undesired stains are formed on the edge portions of the recording paper.

SUMMARY OF THE INVENTION

Therefore, an object of the present invention is to obviate the aforementioned shortcoming of the prior art, by providing an improved electrophotographic apparatus which prevents generation of undesired stains at the edge portions of the recording paper so as to maintain a high picture quality even when a plurality of copied pictures are produced from one electrostatic latent image.

The inventors have carried out a series of studies on the causes of the undesired stains at the edge portions of the recording paper, and found out that injection of undesired electric charge from a transferring roller to edge portions of a photosensitive member takes place during the transfer of the developed images and this undesired electric charge injected into the edge portions of the photosensitive member causes the aforementioned stains.

A feature of the invention is the provision, in such electrophotographic apparatus, of the improvement comprising an electric charge removing device arranged between said corona discharge device and said transferring device and for removing electric charge from edge portions of said photo sensitive member after said transferring but before a next succeeding development of said latent image in the course of repeating developments and transferrings of one electrostatic latent image once formed on said photosensitive member.

Further objects and features of the invention will be fully understood from the following detailed description with reference to the accompanying drawings, wherein:

BRIEF DESCRIPTION OF THE DRAWING

Like parts are designated by like numerals and symbols throughout different views of the drawings.

DESCRIPTION OF THE PREFERRED EMBODIMENT

Figure 1:
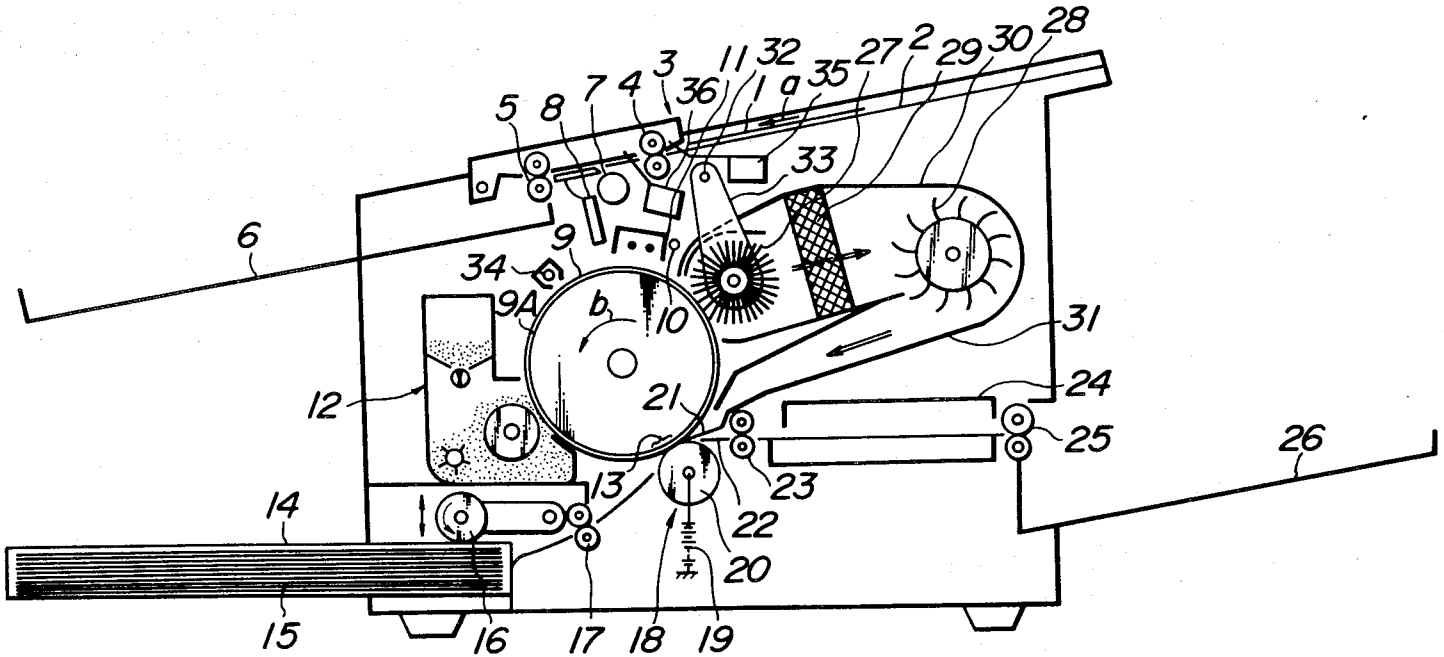
FIG. 1 PRIOR ART
FIG. 1 is a schematic sectional view of one example of a conventional electrophotographic apparatus.

FIG. 1 shows a conventional electrophotographic apparatus in which a sheet-like original 1 to be copied is placed on an inclined original table 2 and moved into an original feeder 3 in a direction shown by an arrow a, feeding rollers 4 and 5 of the original feeder 3 feed the original 1 toward an original tray 6 while causing the original to pass above an illuminating lamp 7 and an optical system 8. The optical system 8 projects an image of the illuminated original 1 onto a rotary photosensitive drum 9. The photosensitive drum 9 has a photoconductive layer 9A, which for instance consists of selenium (Se), and rotates in a direction shown by an arrow b. After being removed discharge by a charge removing lamp 10, the photoconductive layer 9A is uniformly charged by a corona discharge device 11, so that upon projection of the aforesaid image of the original, an electrostatic latent image is formed on the photoconductive layer 9A. This latent image is developed by a development device 12 which makes use of dry two component developing agent, and then the developed image is forwarded to a toner-transfer station 13 as the photosensitive drum 9 rotates.

On the other hand, a recording paper cassette 14 carries plural sheets of recording paper 15, and a rotary pickup roller 16 picks up the recording paper 15 one sheet at a time, so as to feed the recording paper 15 to the toner-transfer station 13 at predetermined timing by rollers 17. The toner-transfer station 13 has a bias-roller transfer unit 18 including a bias voltage source 19 and a transfer roller 20, and the recording paper 15 passes between the photosensitive drum 9 and the transfer roller 20 so as to overlay the toner image onto the recording paper 15 to transfer the toner image thereon. During this process, the recording paper 15 moves together with the toner image, i.e., in tight contact with the surface of the photosensitive drum 9, until separating pawls 21 separate the recording paper 15 from the drum 9 in cooperation with an air flow to be described hereinafter. A guide 22 directs the recording paper 15 to feeding rollers 23 which feed the recording paper 15 to a thermal fixing device 24 having a heater for fixing the toner image. Discharge rollers 25 discharge the recording paper 15 with the fixed toner image onto a copy tray 26. Since the toner image on the photosensitive drum 9 is not completely transferred to the recording paper 15 and partially remains on the drum 9, a rotary cleaner brush 27 brushes off the residual toner from the photosensitive drum 9 after the toner image passes through the toner-transfer station 13. A fan 28 generates an air flow to suck the brushed off toner, and a filter 29 collects the toner particles from the air flow. A housing 30 encloses the cleaner brush 27 and the fan 28 to produce an effective suction for sucking the toner and to prevent the toner particles from being scattered in the apparatus. The exhaust from the fan 28 is guided by a duct 31 having an outlet facing the toner-transfer station 13, so that the exhaust air flow from the outlet of the duct 31 coacts with the separating pawls 21 in separating the recording paper 15 from the photosensitive drum 9 in a reliable fashion.

A support pin 32 swingably carries one end of an arm 33, and the opposite end of the arm 33 rotatably holds the rotary cleaner brush 27. The cleaner brush 27 is kept away from the photosensitive drum 9 when the electrostatic latent image once formed on the photosensitive drum 9 is repeatedly subjected to development and transferring for copying one original onto a plurality of sheets of the recording paper 15 through the successive transfer of the toner images. A trimming lamp 34 faces the photosensitive drum 9 in the proximity thereof at a position between the image projecting optical system 8 and the developing device 12, so as to remove the electric charge from blind areas or those areas of the photosensitive drum 9 which do not intend to transfer any image to the recording paper 15. Switches 35 and 36 detect the positions of each original 1 in the electrophotographic apparatus, so as to sequentially control the aforementioned constitutional parts of the apparatus.

Figure 2:
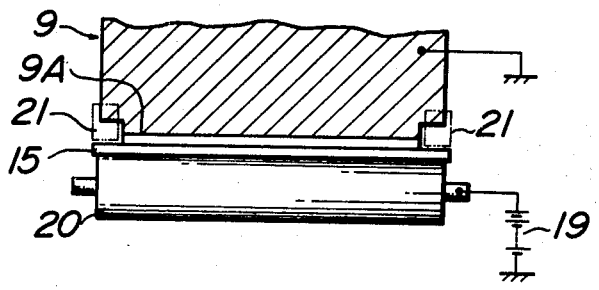
FIG. 2 is a diagrammatic sectional view showing relative positions of a photosensitive drum, a recording paper, and a transfer roller of the electrophotographic apparatus of FIG. 1 during the transfer of an image.

As shown in the example of FIG. 1, in the electrophotographic apparatus which generally uses separating pawls 21 to separate the recording paper 15 from the photosensitive drum 9, after transferring the toner image formed on the photosensitive drum 9 to the recording paper 15 through the transfer drum 20, the width of the photoconductive layer 9A on the surface of the photosensitive drum 9 is made narrower than that of the recording paper 15 of the largest size being handled by the apparatus, while the width of the transfer roller 20 is made substantially the same as that of the recording paper 15 as shown in FIG. 2. In the electrophotographic apparatus having the photoconductive layer 9A narrower than the largest width of the recording paper 15, if the electrostatic latent image once formed on the photosensitive drum 9 is repeatedly used to produce copied images on successive sheets of the recording paper 15 through repeated developments and transferrings, undesired stains of about 0.3 to 1 mm width have been produced at edge portions of the recording paper 15 corresponding to the edge portions of the photoconductive layer 9A with the increase of the number of repeated transferrings.

Figure 3:
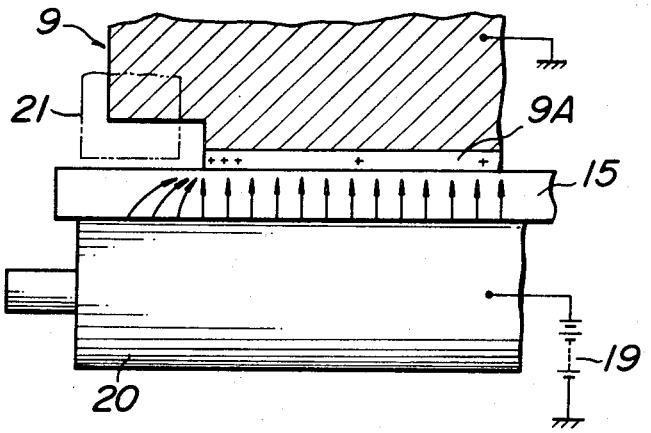
FIG. 3 is a diagram illustrating the distribution of electric field intensity during the transfer of the image in the apparatus of FIG. 1.

The inventors have conducted various studies on the cause of the aforementioned stains, and they found out that the stains are caused by injection of undesired electric charge into the photoconductive layer 9A from the transfer roller 20 during the transferring. More particularly, the polarity of the bias voltage applied from the voltage source 19 to the transfer roller 20 is the same as that of the electrostatic latent image formed on the photoconductive layer 9A, i.e., opposite to the polarity of the electric charge of the toner. As shown in FIG. 3, during the transfer of the toner image, the photoconductive layer 9A faces the transfer roller 20 with the recording paper 15 inserted therebetween, and the electric field for the transfer is uniform at the central portion of the photoconductive layer 9A is shown by the arrows representing the electric lines of force, but at the edge portions of the photoconductive layer 9A the electric lines of force are concentrated and the electric field intensity at the edges is higher than that at the central portion. Accordingly, especially at the edge portions of the photoconductive layer 9A, undesired electric charge of the same polarity as that of the electrostatic latent image is injected therein from the transfer roller 20 through the recording paper 15 and stored therein at each transferring operation, which undesired electric charge thus injected and stored are developed during the next succeeding development and transferred onto the recording paper 15 so as to cause the undesired stains.

Although the degree of the aforementioned injection of the undesired electric charge into the edge portions of the photoconductive layer 9A depends on the electric resistance of the recording paper 15 being used, such injection of the undesired electric charge occurs even if recording paper with a high electric resistance is used. A high ambient humidity tends to intensify the injection of the undesired electric charge.

Figure 4:
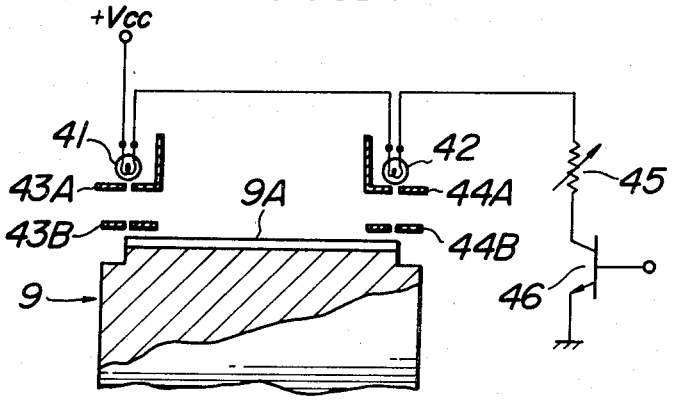
FIG. 4 is a schematic view showing essential portions of an electrophotographic apparatus according to the present invention.

FIG. 4 schematically illustrates essential portions of an embodiment of the electrophotographic apparatus to obviate the aforementioned difficulties due to the injection of the undesired electric charge. In the figure, lamps 41 and 42 are disposed in the proximity of the photosensitive drum 9 at an angular position of the bias-roller transfer device 18 or immediately after the device 18 as seen in the revolving direction b of the drum 9 as shown in FIG. 1, so as to face opposite edge portions of the photoconductive layer 9A. The light from the lamp 41 proceeds through slits 43A and 43B toward one-side edge portion of the photoconductive layer 9A, while the light from the lamp 42 proceeds through slits 44A and 44B toward the opposite-side edge portion of the photoconductive layer 9A. The slits 43A and 44A are disposed close to the lamps 41 and 42, and the slits 43B and 44B are located in the close vicinity of the corresponding edge portions of the photoconductive layer 9A, whereby sharply directed light beams of 0.5 to 2 mm width become incident to the edge portions of the photoconductive layer 9A. The disposed slits 43A, 43B, 44A, and 44B prevent the light beams of the lamps 41 and 42 from being scattered toward the inner portion of the photoconductive layer 9A. As a result, only the electric charge at the edge portions of the photoconductive layer 9A is removed during formation of a plurality of sheets of copied images from one electrostatic latent image once formed on the photoconductive layer 9A, while maintaining the electrostatic latent image intact without being erased at the inner portion of the photoconductive layer 9A.

In the illustrated embodiment of the invention, the lamps 41 and 42 are connected in series to a D.C. power source $V_{cc}$ through a variable resistor 45 and the collector-emitter circuit of a transistor 46. Suitable signals are selectively applied to the base of the transistor 46, so as to make the transistor 46 conductive at desired moments to energize the lamps 41 and 42. The brightness of the lamps 41 and 42 can be regulated by changing the resistance value of the variable resistor 45. The control of the switching of the transistor 46 to selectively energize the lamps 41 and 42 can be effected in various ways; for instance, the lamps 41 and 42 may be continuously lit throughout formation of a plurality of sheets of copied images from one electrostatic latent image once formed on the photoconductive layer 9A; or the lamps 41 and 42 may be selectively lit each time when a predetermined number of sheets of the copied image have been formed. The continuous lighting of the lamps 41 and 42 can be easily fulfilled, for instance, by using a flip-flop circuit (not shown) to be set by a copy-start signal and reset by a copy-end signal, a Q signal from the flip-flop circuit (not shown) being applied to the base terminal of the transistor 46. The aforementioned selective lighting of the lamps 41 and 42 can be also easily fulfilled, for instance, by using a first counter (not shown) to count the number of copies being made and a second counter (not shown) adapted to generate an output signal and be reset when the number of copies being made has reached a predetermined value, the output signal from the second counter (not shown) being applied to the base terminal of the transistor 46. Since the amount of the undesired electric charge being injected in the edge portions of the photoconductive layer 9A from the transfer roller 20 through the recording paper 15 increases with the rise of ambient humidity as pointed out before, the control of the brightness of the lamps 41 and 42 by the variable resistor 45 can be related to the ambient humidity; for instance, the resistance value of the variable resistor 45 is regulated manually or automatically in response to variation of the ambient humidity, so as to intensify the brightness of the lamps 41 and 42 when the ambient humidity is high. Whereby, the undesired electric charge injected into the aforementioned manner can be efficiently removed, with little consumption of electric power.

In the figure, the lamps 41 and 42 are disposed in the proximity of the photosensitive drum 9 so as to face opposite the side edge portions of the photoconductive layer 9A, respectively. According to the invention, since the undesired electric charge injected from the transferring roller 20 onto the photoconductive layer 9A along its side edge portions should be removed, the lamps 41 and 42 are positioned at any angular position between the transferring roller 20 and the developing device 12 viewed in the revolving direction b of the drum 9 as shown in FIG. 1.

As described in the foregoing, according to the present invention, in repeated developments and transferrings of an electrostatic latent image once formed on a photosensitive member, undesired electric charge injected into edge portions of the photosensitive member through recording paper during the transferring is removed after the transferring but before next development, so that copied pictures of good quality are produced on plural sheets of the recording paper without deterioration during the repeated transferring.

The present invention is not restricted to the aforementioned embodiment, and numerous modifications and changes are possible without departing from the scope of the invention. For instance, although the removal of the undesired electric charge at the edge portions of the photosensitive drum is carried out by the projection of light in the illustrated embodiment, such removal can be also effected either by applying A.C. corona discharge (not shown) strictly to the edge portions of the photoconductive drum, or by bringing earthed electric conductors (not shown) into contact with the edge portions of the photosensitive drum so as to discharge the undesired electric charge therefrom. The present invention has been described by referring to the embodiment applied to a bias-roller transfer device, and it is understood that the present invention can be also effectively applied to a corona discharge transfer device which is susceptible to injection of undesired electric charge into edge portions of a photosensitive member during the transferring. Furthermore, in order to make the effective width of the photosensitive member narrower than that of the recording paper, the illustrated embodiment uses annular notches formed along opposite edges of the photosensitive member which notches receive separating pawls to separate the recording paper that is in tight contact with the photosensitive member at the end of the transferring, but it is also possible to form the aforesaid means either by using a separating belt (not shown) adapted to rotate in such a manner that the separating belt engages the edge portion of the recording paper after the transferring to separate the recording paper from the photosensitive member, or by forming grooves or notches (not shown) on the photosensitive member to abundantly supply liquid developer to the photosensitive member in the case of using the liquid developer for developing the electrostatic latent image on the photosensitive member. The present invention is applicable to an electrophotographic apparatus which uses the aforementioned separating belt (not shown) or the aforementioned grooves or notches (not shown) together with liquid developer.

What is claimed is:

1. In an electrophotographic apparatus comprising, a moving photosensitive member whose width is narrower than that of a recording sheet of paper, a corona discharge device for uniformly charging said photosensitive member, an image-projecting member for projecting an original image on said photosensitive member so as to produce an electrostatic latent image thereon, a developing device for developing said latent image, and a transferring device for transferring the developed image onto the recording paper, whereby said corona discharge device, image projecting member, developing device and transferring device are arranged along the periphery of the photosensitive member in this order viewed in a moving direction of the photosensitive member and the electrostatic latent image once formed on the photosensitive member is repeatedly subjected to development and transferring for copying one original onto a plurality of sheets of the recording paper, the improvement comprising an electric charge removing device arranged between said transferring device and said developing device viewed in the moving direction of the photosensitive member and for removing undesired electric charge from an edge portion of said photosensitive member after said transferring but before the next succeeding development of said latent image in the course of regarding developments and transferrings of one electrostatic latent image once formed on said photosensitive member, said undesired electric charge being injected onto the edge portion of said latent image on the photosensitive member via the recording paper by the transferring device, wherein said electric charge removing device comprising a lamp and a pair of spaced slits, one slit being disposed close to the lamp and the other slit being disposed closed to the photosensitive member to produce a sharply directed light beam to the edge portion of the photosensitive member.

2. An electrophotographic apparatus as set forth in claim 1, wherein said light beam has a width of 0.5 to 2 mm.

3. An electrophotographic apparatus as set forth in claim 2, wherein said electric charge removing device further includes a variable resistor and a collector-emitter path of a transistor connected in series between said lamp and an electric source so as to require the brightness of said lamp and to turn on and off said lamp.

4. An electrophotographic apparatus as set forth in claim 2, wherein said removing device further includes a variable resistor and a collector-emitter passage of a transistor connected in series between said lamps and an electric source so as to regulate brightness of said lamps and to turn on and off said lamps.

* * * * *